US011376487B1

(12) United States Patent
Rowland

(10) Patent No.: US 11,376,487 B1
(45) Date of Patent: Jul. 5, 2022

(54) ROLLER SKATE TRUCKS

(71) Applicant: Hugh Rowland, Marden (AU)

(72) Inventor: Hugh Rowland, Marden (AU)

( * ) Notice: Subject to any disclaimer, the term of this patent is extended or adjusted under 35 U.S.C. 154(b) by 0 days.

(21) Appl. No.: 17/175,740

(22) Filed: Feb. 15, 2021

(51) Int. Cl.
*A63C 17/01* (2006.01)
*A63C 17/02* (2006.01)

(52) U.S. Cl.
CPC ..... *A63C 17/02* (2013.01)

(58) Field of Classification Search
CPC ..... A63C 17/00; A63C 17/02
See application file for complete search history.

(56) References Cited

U.S. PATENT DOCUMENTS 4,311,319 A * 1/1982 Snyder ..... A63C 17/02 280/11.28
4,372,566 A * 2/1983 Smith ..... A63C 17/02 280/11.19
6,182,987 B1 * 2/2001 Bryant ..... A63C 17/0093 280/11.28
7,104,558 B1 * 9/2006 Saldana ..... A63C 17/0093 280/11.27
8,657,302 B1 * 2/2014 Chen ..... A63C 17/02 280/11.231
2011/0316245 A1 * 12/2011 Burke ..... A63C 17/0093 280/11.27
2013/0175774 A1 * 7/2013 Lininger, Jr. ..... A63C 17/0093 280/11.27
2019/0232152 A1 * 8/2019 Lininger, Jr. ..... A63C 17/012
2020/0179791 A1 * 6/2020 Williams, Jr. ..... A63C 17/015
2021/0245034 A1 * 8/2021 Braden ..... A63C 17/015

* cited by examiner

*Primary Examiner* — Brian L Swenson
(74) *Attorney, Agent, or Firm* — Sand, Sebolt & Wernow Co., LPA

(57) ABSTRACT

A boss for use with a roller skate and attached to a king pin of the roller skate and adapted to removably support an axle housing. The boss supports a pivot pin adaptor having an adjustable pin fixed into place by a lock nut. The pivot pin adaptor includes a shoulder internally abutting the boss and different angled shoulders can be attached to the boss to adjust the angle of the pin.

4 Claims, 4 Drawing Sheets

ROLLER SKATE TRUCKS

FIELD OF THE INVENTION

The present invention relates roller skates and to roller skate trucks.

BACKGROUND TO THE INVENTION

Roller skating is a popular past time by both children and adults. Besides simply skating around it is also popular to do tricks with roller skates so much so that there are numerous roller skate parks around the world.

The truck of a roller skate is the piece, typically made of metal, that the wheel axle passes through. The trucks attach to the plate and hold the wheels. You can tighten or loosen the trucks tension nut to vary the amount of control you want in your pair of skates. The average skater will have their trucks tightly fitted to the boot.

A bolt that holds the wheels in place, allowing slight turns as you lean left or right while skating. It acts like a suspension with firm suspension best for racing, while soft suspension is best for luxury and comfort.

The truck is the element that offers the widest range of options as concerns shocks, twists, and overall absorption. Experienced skaters discuss the differences in performance with an expert before purchasing, as subtle changes can make a big difference both in terms of feel and performance.

A wider trucks means one can perform certain tricks such as grinds (along the length of the skate rather than sideways slides on the block), The wider surface also helps with stability and being able to land on the coping sideways.

It is an object of this invention is to provide for an interchangeable axle housing that can be easily removed from the truck body.

SUMMARY OF THE INVENTION

In one form of the invention there is proposed a boss for use with a roller skate and attached to a king pin of the roller skate and adapted to removably support an axle housing.

In preference the boss includes a pivot pin adaptor having an adjustable pin fixed into place by a lock nut.

Preferably the pivot pin adaptor includes a shoulder internally abutting the boss.

Preferably the boss includes two threaded apertures, the axle housing including two co-axial holes aligned with the threaded apertures to enable screws to attach the axle housing to the boss.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will refer to several drawings as follows.

DETAILED DESCRIPTION OF THE INVENTION

Figure 1:
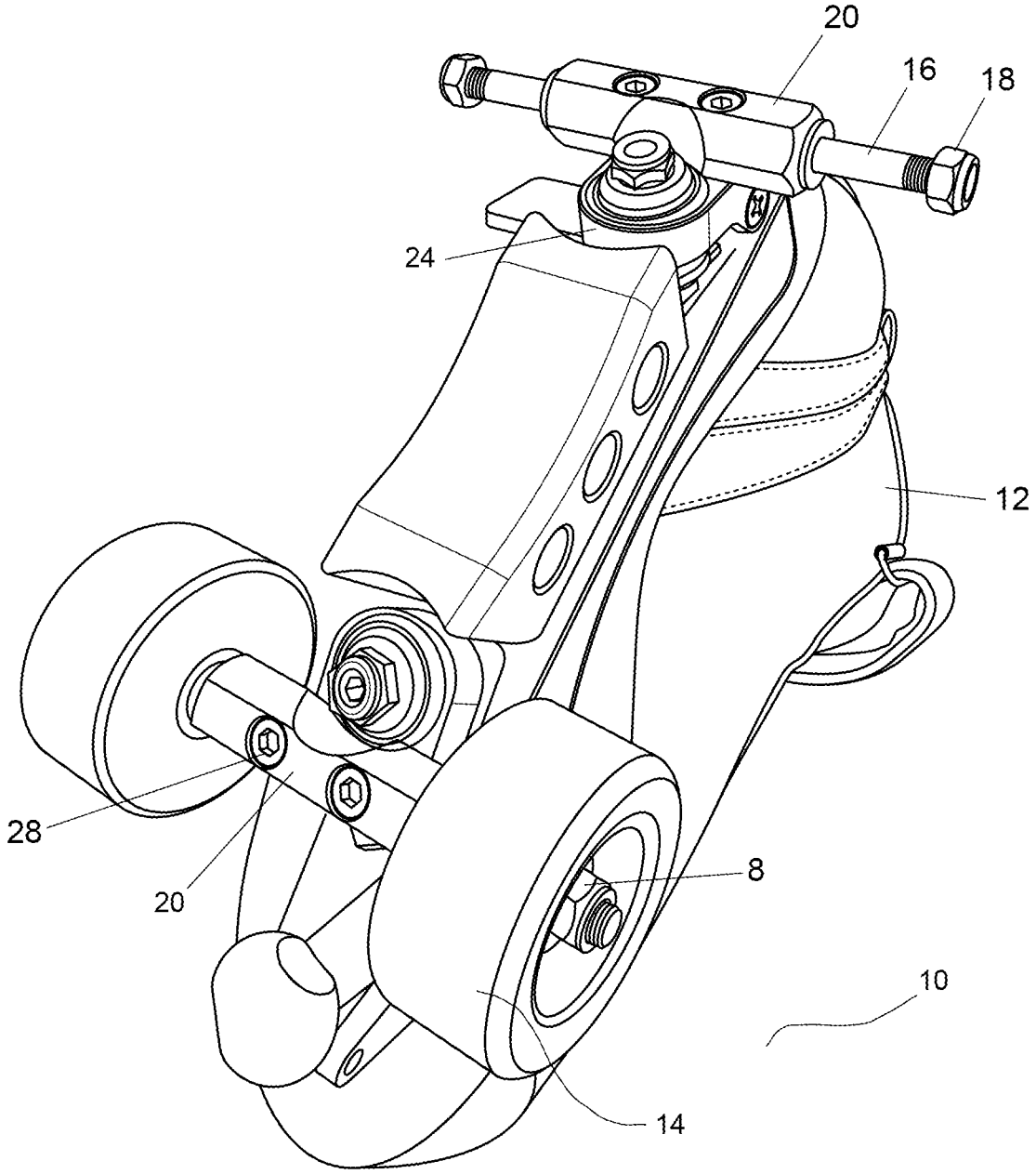
FIG. 1 illustrates a boss with engaging the pivot pin adaptor.
Figure 2:
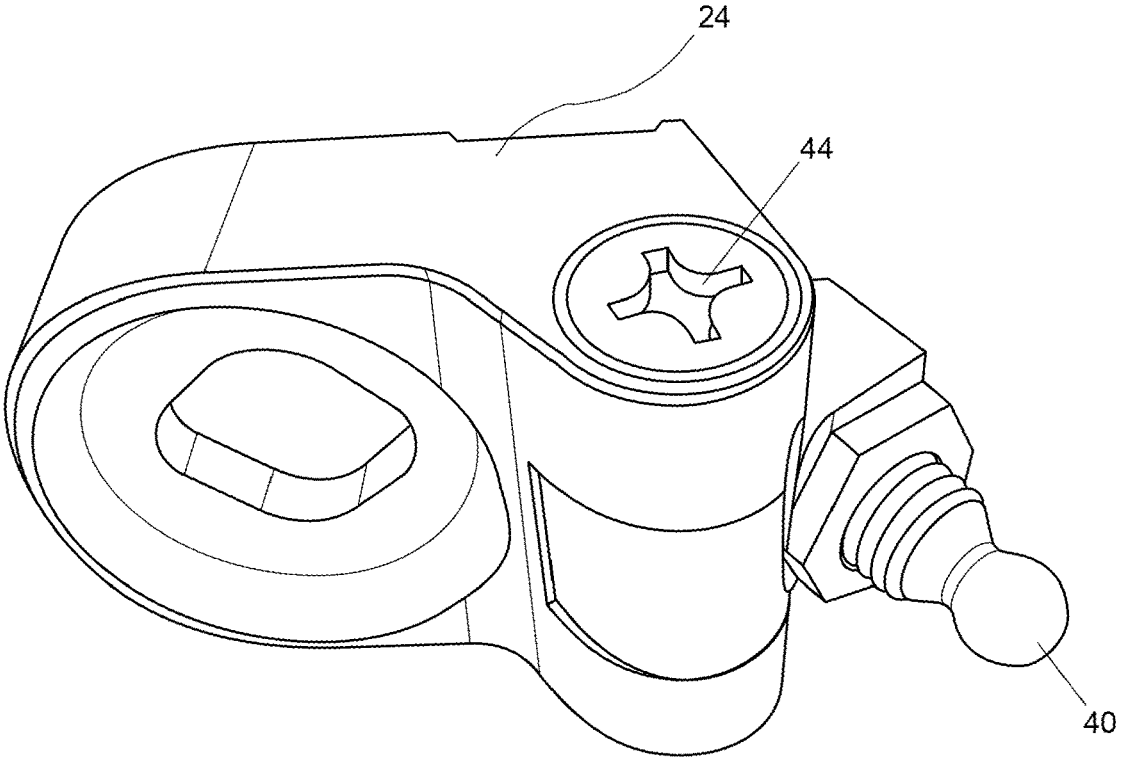
FIG. 2 is the same as FIG. 1 but in a different orientation.
Figure 3:
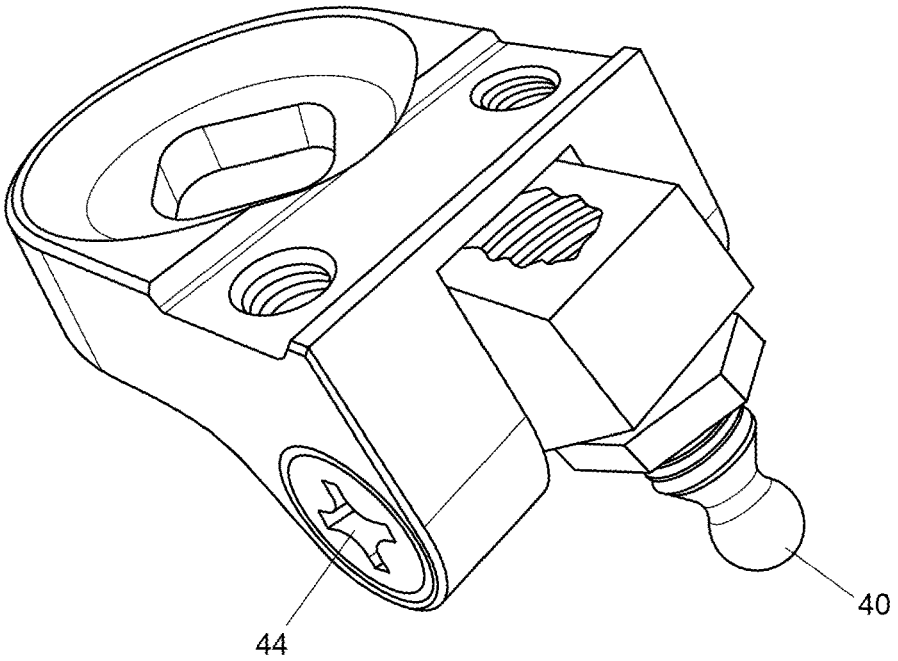
FIG. 3 illustrates the boss and pivot pin adaptor disassembled.
Figure 4:
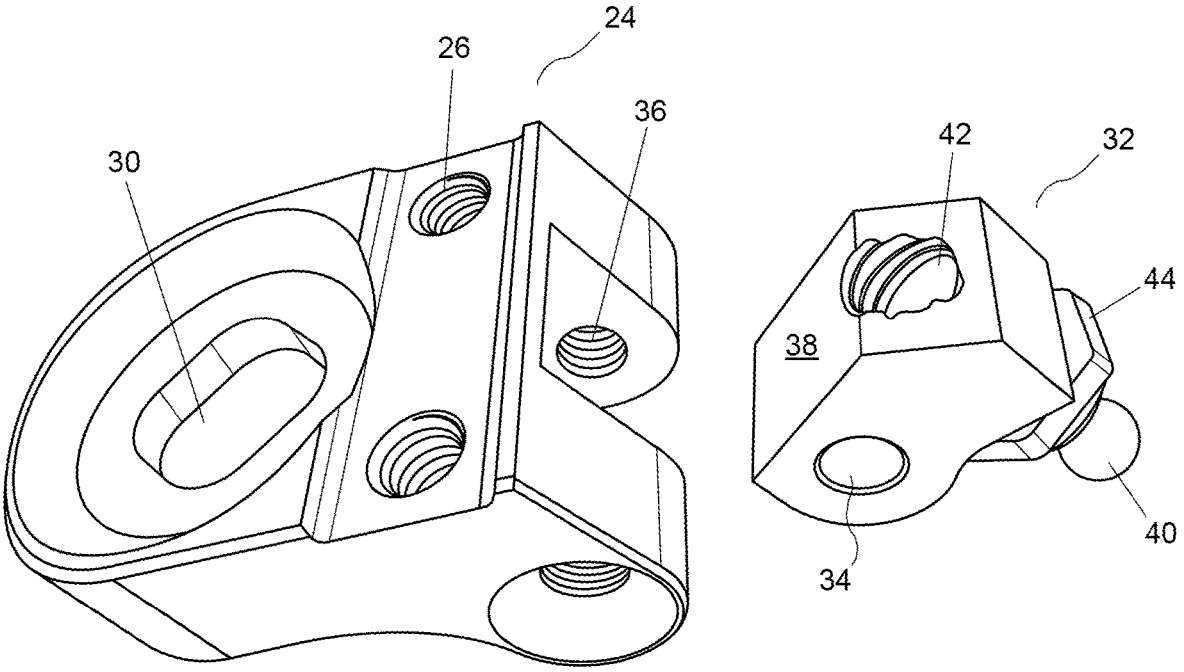
FIG. 4 is another view of the boss and pivot pin adaptor.
Figure 5:
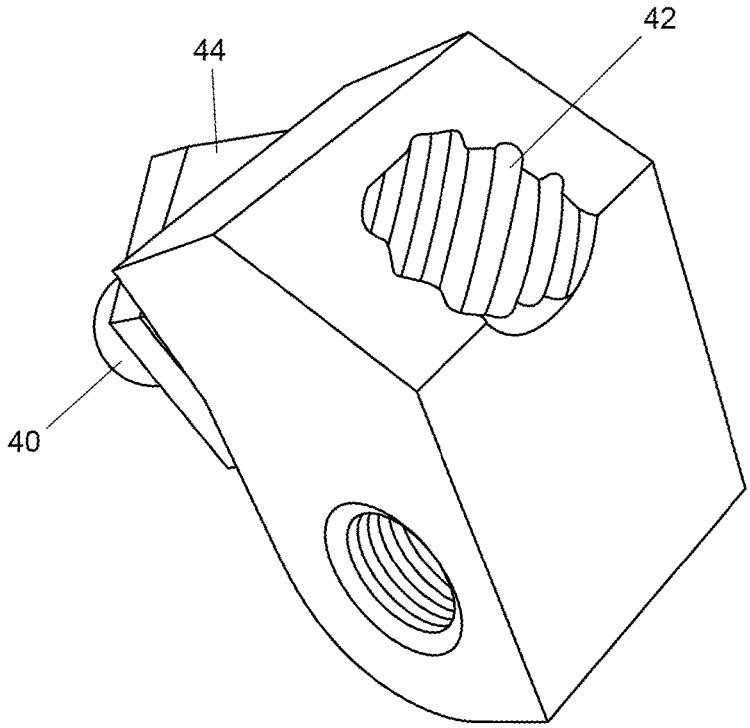
FIG. 5 is a close-up view of the pin adaptor.
Figure 6:
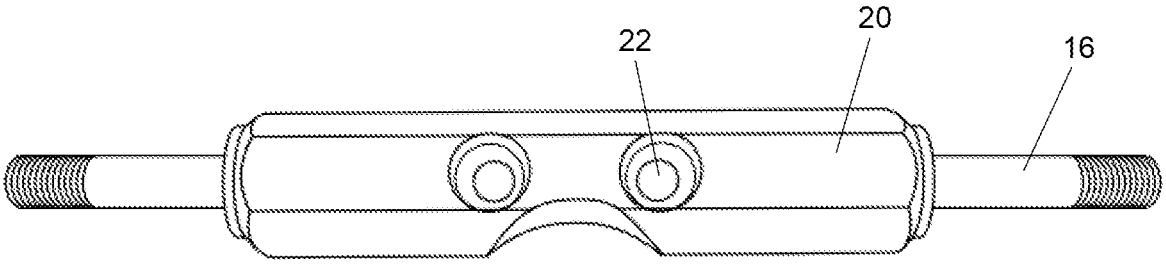
FIG. 6 is a view of the axle housing.

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

As illustrated in the Figures, a roller skate 10 includes a shoe 12, wheels 14 that are supported by an axle 16 and locked into place using nuts 18. The axle forms part of an axle housing that includes hanger 20 including two apertures 22 that are not threaded.

A boss 24 includes threaded holes 26 and screws 28 pass through the hanger apertures 22 and engage the holes 26 to lock the axle hanger and hangar to the boss. The boss engages a king pin through aperture 30 extending from the roller skate (not shown) as is well known in the art and it is not intended to describe those features that are well known.

Pin adaptor 32 engages the boss with a hole 34 coaxially aligned with two threaded apertures 36 in the boss 24 using a screw 44. The adaptor includes a shoulder 38 that internally abuts the boss 24. The pin adaptor includes an adjustable pin 40 secured to the adaptor 32 by engaging another threaded hole 42 and locked in a position using lock nut 44. The pivot pin in its pivot pin adaptor has a lock nut 44 which allows it to adjust in the pivot pin adaptor 32. This pivot pin adaptor part can be designed in two different shapes, one with a steep angle and one with a shallow angle. Commonly it will be supplied with a shallow angle adaptor, it is uncommon for it to be steep.

The reader should now start to appreciate the present invention. Part of the benefit of this design is that the axle housing is detachable from the boss when installed on the roller skates and you can introduce a wider axle housing without requiring significant dismantling of the roller skate.

The present invention facilitates bringing a wider truck onto an existing roller skate plate. A standard width truck to roller skate is typically 50 mm—the standard width that one buys off the shelf is a 50 mm truck. The truck is the entire element of boss and axle together.

On the pivot pin adapter, the purpose of having a shallow and steep angles is that the king pin of trucks can be anywhere between 7 and 15 degrees and 20 and 31 degrees even. Common graduations are 7, 10, 15, 20 and 31.

For each truck, its relationship between its king pin and its approach to its pivot pin cup, this angle can be of these graduations.

The graduations are determined by the plate that is provided with a roller skate. The benefit of this invention, of it being adapted to be shallow or steep, is to facilitate between these angles.

The present invention provides for an interchangeable axle housing. In current roller skates designs the axle housing cannot be removed from the truck body or boss being a one cast part.

LIST OF COMPONENTS

The drawings include the following integers.

10 roller skate
12 shoe
14 wheels

16 axle
18 nuts
20 hanger
22 apertures
24 boss
26 threaded holes
28 screws
30 aperture
32 pin adaptor
34 hole
36 threaded apertures
38 shoulder
40 adjustable pin
42 threaded hole
44 lock nut
44 screw Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims to embrace all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A boss for use with a roller skate and attached to a king pin of the roller skate and adapted to removably support an axle housing, wherein the boss defines two threaded apertures, and wherein the axle housing includes two co-axial holes aligned with the threaded apertures to enable screws to attach the axle housing to the boss.

2. The boss as in claim 1 including a pivot pin adaptor having an adjustable pin fixed into place by a lock nut.

3. The boss as in claim 2 wherein the pivot pin adaptor includes a shoulder internally abutting the boss.

4. A roller skate including a boss as defined in claim 1.

* * * * *